US006732728B2

(12) United States Patent
Hill et al.

(10) Patent No.: US 6,732,728 B2
(45) Date of Patent: May 11, 2004

(54) AIR BAFFLE FOR A HEAT EXCHANGER

(75) Inventors: Terry E. Hill, Nashville, TN (US); Kenneth D. Johns, Chapel Hill, TN (US)

(73) Assignee: Carrier Corporation, Farmington, CT (US)

( * ) Notice: Subject to any disclaimer, the term of this patent is extended or adjusted under 35 U.S.C. 154(b) by 61 days.

(21) Appl. No.: 10/042,436

(22) Filed: Jan. 10, 2002

(65) Prior Publication Data

US 2003/0127087 A1 Jul. 10, 2003

(51) Int. Cl.[7] ..... F24H 3/00; F24C 15/00

(52) U.S. Cl. ..... 126/110 R; 126/99 D; 165/159; 165/170

(58) Field of Search ..... 126/110 R, 99 R, 126/99 D; 165/179, 159, 401

(56) References Cited

U.S. PATENT DOCUMENTS 5,333,597 A * 8/1994 Kirkpatrick et al. .... 126/110 R
5,370,529 A * 12/1994 Lu et al. ..... 431/353
5,448,986 A * 9/1995 Christopher et al. .... 126/110 R
6,422,306 B1 * 7/2002 Tomlinson et al. ..... 165/170
6,564,794 B1 * 5/2003 Zia et al. ..... 126/110 R
6,564,795 B1 * 5/2003 Sears et al. ..... 126/110 R

* cited by examiner

*Primary Examiner*—Alfred Basichas
(74) *Attorney, Agent, or Firm*—Wall Marjama & Bilinski LLP

(57) ABSTRACT

The invention is applicable to a furnace having a plurality of parallel, multi-pass pass heat exchanger panels that are susceptible to the occurrence of hot spots at a specific location. A baffle is installed between adjacent panels and is so placed and spaced from that location as to cause the flow of circulation air to be diverted to that location to prevent the occurrence of hot spots. The baffle may be integrally formed as an extension of a rear wall baffle which is attached to the rear wall and extends normally therefrom to divert circulation air away from the rear wall. The baffle is relatively planar and elongate in shape and is closely spaced from but does not engage the surface of the heat exchanger panels.

14 Claims, 3 Drawing Sheets

AIR BAFFLE FOR A HEAT EXCHANGER

BACKGROUND OF THE INVENTION

This invention relates generally to furnaces and, more particularly, to an air baffle for diverting air over a particular portion of a furnace heat exchanger for preventing hot spots.

Residential furnaces typically include a plurality of heat exchanger panels or cells arranged in parallel relationship, with the air to be heated being circulated by a blower so as to pass between the panels and over the surfaces of the panels, to be heated. The panels have associated burners for heating the air within the panels, and an inducer may be employed to draw the heated air through the panels and discharge them to a flu.

One form of heat exchanger that is commonly used in such furnaces is a so-called clamshell heat exchanger, wherein two stamped metal shells are fastened together to form a single panel having a plurality of serpentine passages, or passes, through which the hot gases can be caused to flow. Thus, a burner heats the air at an inlet end thereof, and the hot gases pass through successive passes and finally come out of the exit end of the panel to eventually be discharged to the flu. As the gases pass from the inlet to the exit end of the panel, they are cooled by the air being circulated over the surface of the panel. Thus, the gases in the first pass are at substantially higher temperatures than those downstream thereof, and care must be taken to prevent the occurrence of excessive temperatures. In particular, hot spots are most likely to occur in the vicinity between the first return bend and the second pass. These hot spots cause not only exposure to high temperatures, but also to undesirable temperature gradients that can cause excessive strain levels in the material of the heat exchanger structure and may eventually lead to failure.

It is therefore an object of the present invention to provide an improved furnace heat exchanger apparatus.

Another object of the present invention is to provide a heat exchanger apparatus with reduced thermal stress.

Yet another object of the present invention is the provision for maintaining the temperatures on the surface of a heat exchanger panel within acceptable limits.

Still another object of the present invention is the provision in heat exchanger apparatus for lowering both the peak temperatures and the temperature gradients on the surface of a heat exchanger.

These objects and other features and advantages become more readily apparent on reference to the following descriptions when taken in conjunction with the appended drawings.

SUMMARY OF THE INVENTION

Briefly, in accordance with one aspect of the invention, a baffle structure is positioned between a pair of heat exchanger panels, with the location being such that the baffle tends to divert a portion of the circulated air over the localized surface where hot spots are likely to occur on the heat exchanger panel. The increased air flow over that surface reduces both the peak temperatures and the temperature gradients that occur.

In accordance with another aspect of the invention, the baffle is an elongate, relatively flat member that is positioned near the transition between the first return bend and the second pass, and extends substantially parallel with the second pass. The baffle causes circulating air to be diverted over the localized area of each of the adjacent panels, which area would otherwise be susceptible to hot spots.

In accordance with another aspect of invention, a plurality of baffles are provided, with the baffles being integrally combined with a rear wall bracket or baffle, which is installed for the purposes of both channeling the flow of circulation air away from the rear wall and toward the heat exchanger panels, and maintaining proper spacing between adjacent heat exchanger panels. The bracket is fastened to the furnace casing and includes spacer portions that engage the panels on either side thereof, as well as baffle portions which extend into positions between, but do not engage, adjacent heat exchanger panels.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
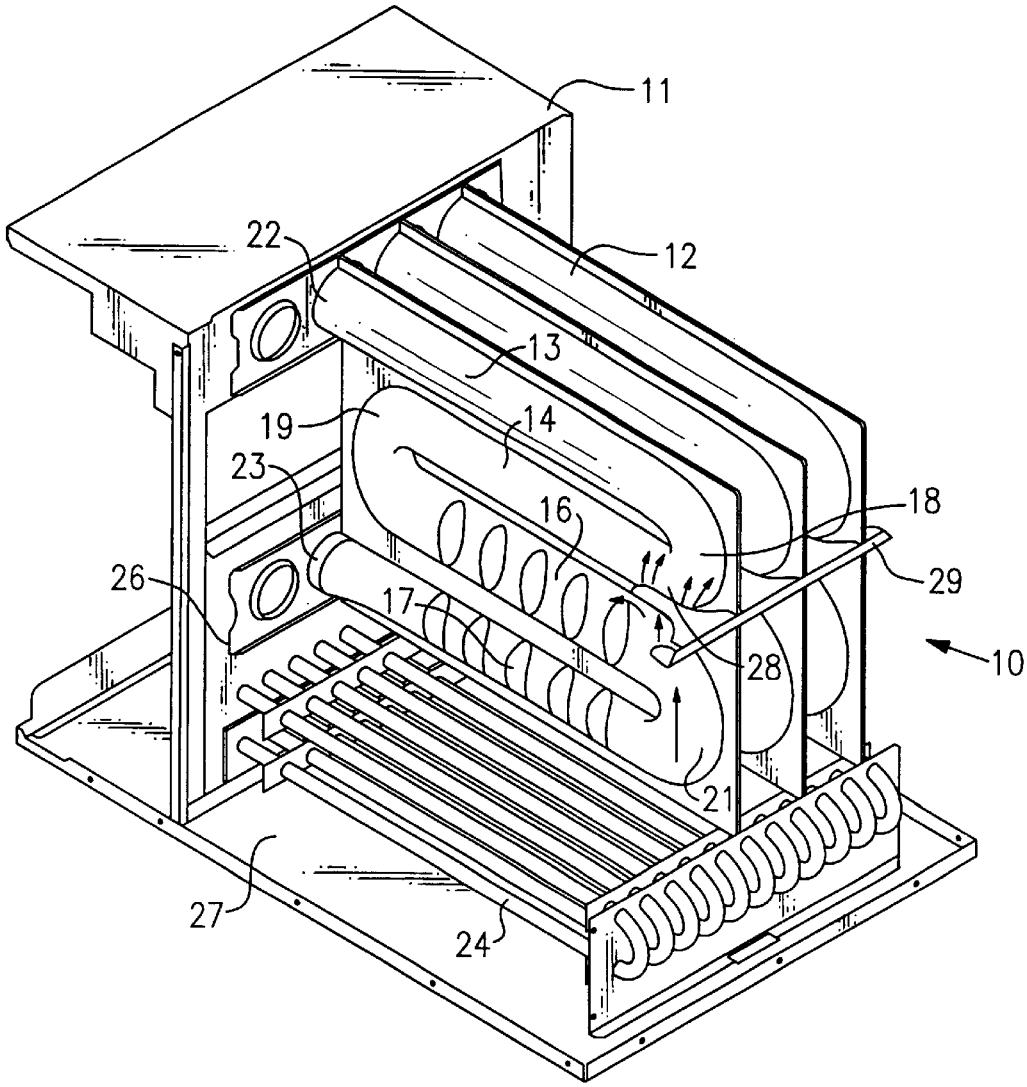
FIG. 1 is a perspective view of the present invention as applied to heat exchanger panels of a counterflow furnace.

Referring to FIG. 1, the invention is shown generally at 10 as applied to a furnace 11 having a plurality of primary heat exchanger panels 12 arranged in parallel relationship as shown. The heat exchanger panels 12 are on the multiple pass type and include a first pass 13, a second pass 14, a third pass 16, and the fourth pass 17, with the passes being fluidly interconnected by a first return bend 18, a second return bend and a third return bend 21. Each of the heat exchanger panels 12 also includes an inlet opening 22 and an exit opening 23.

The furnace 11 also has a plurality of secondary or condensing heat exchanger tubes 24 which are in fluid communication with the primary heat exchanger panels 12 .

Both the primary heat exchanger panels 12 and the condensing heat exchanger tubes 24 are partially supported by both a front sell panel 26 and a blower shelf 27. Mounted within the furnace, below the blower shelf 27 , is a circulation air blower which causes circulation air to flow upwardly, first over the condensing heat exchanger tubes 24 and then over the primary heat exchanger panels 12, with heat being transferred from the heat exchangers to the circulation air, which then flows to ducts and is distributed to spaces to be heated. The heat within the heat exchangers originates from burners that are located in the inlet openings 22 of the primary heat exchanger panels 12. The hot gases are drawn through the various passes of the primary heat exchanger panels 12 and to the condensing heat exchanger tubes 24 by an inducer parent not shown), which is located downstream of the condenser heat exchanger tubes 24. The relatively cool gases are then passed by the inducer through a vent to the atmosphere. All of this structure and manner of operation is conventional in the residential furnace industry.

A problem that arises with such a system is that of the occurrence of hot spots near the first return bend 18. In particular, hot spots are most likely to occur in that transition area 28 between the first return bend 18 and the second pass 14. It is this problem that the present invention addresses.

Figure 2:
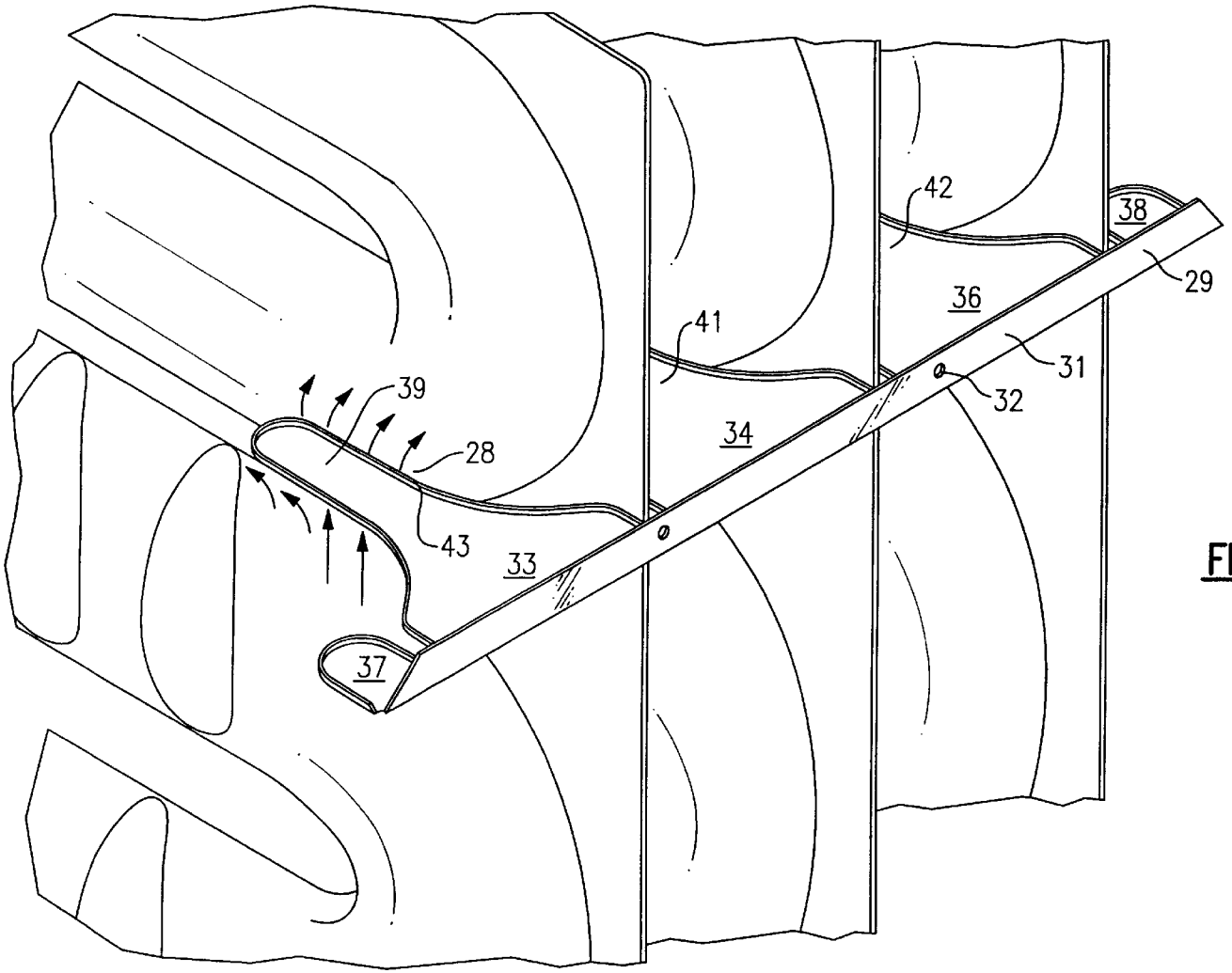
FIG. 2 is a larger scale perspective view of the baffle portion thereof.

Referring to FIGS. 1 and 2, a bracket 29 is shown. Portions of the bracket 29 comprise a so-called rear wall baffle which includes an attachment flange 31 with screw holes 32, and base portions 34, 34 and 36. The attachment flange 31 is the text directly to the rear wall of the furnace, and the integrally attached base portions 34, 34 and 36 extend substantially normally therefrom and serve two purposes. First, they are in direct engagement with the heat exchanger panels on either side thereof for purposes of maintaining those panels in their installed positions. Secondly, they act to direct a portion of the circulation air away from the rear wall and out toward the heat exchanger panels. That is, there is a certain amount of circulation air that would otherwise tend to flow in a laminar manner along the surface of the rear wall and not be effectively heated by the heat exchanger panels. The base portions 33, 34 and 36 tend to break up that laminar flow and direct the air to the active area for heat exchange purposes. Smaller base portions 37 and 38 are shown at the ends of the bracket 29 where they have only a single heat exchanger panel on one side thereof and a side wall on the other side thereof.

Integrally attached to and forming an extension of the base portions 33, 34 and 36 are the respective baffles 39, 41 and 42. These baffles extend substantially normally from the rear wall and in parallel relationship with the individual passes. Unlike the base portions 34, 34 and 36, the baffles 39, 41 and 42 do not engage the individual heat exchanger panels but are spaced therefrom, such that the circulating air coming from below is diverted by the baffles and caused to flow between the baffles and the heat exchanger panels as shown by the arrows. In particular, the baffles are located near the location where hot spots would otherwise occur, and the diverted air flowing over those locations, acts to cool that area and prevent the occurrence of hot spots. For example, tests have shown that in a furnace having no baffles 39, 41 and 42, but with only a rear wall baffle (i.e. with a bracket having only the base portions 34, 34 and 36), hot spots with temperatures in the range of 1000–1060 F will occur. Whereas, in the furnace with the baffles 39, 41 and 42 included, the temperatures in that area will be in the range of 900–960 F.

As will be seen in FIG. 2, the baffles 39, 41 and 42 include a rolled up edge 43, which provides strength to the baffles and also facilitates the streamlined flow of circulation air over the edges. This rolled up edge 43 can also be extended to the edges of the base portions 34, 34 and 36 as shown.

Figure 3:
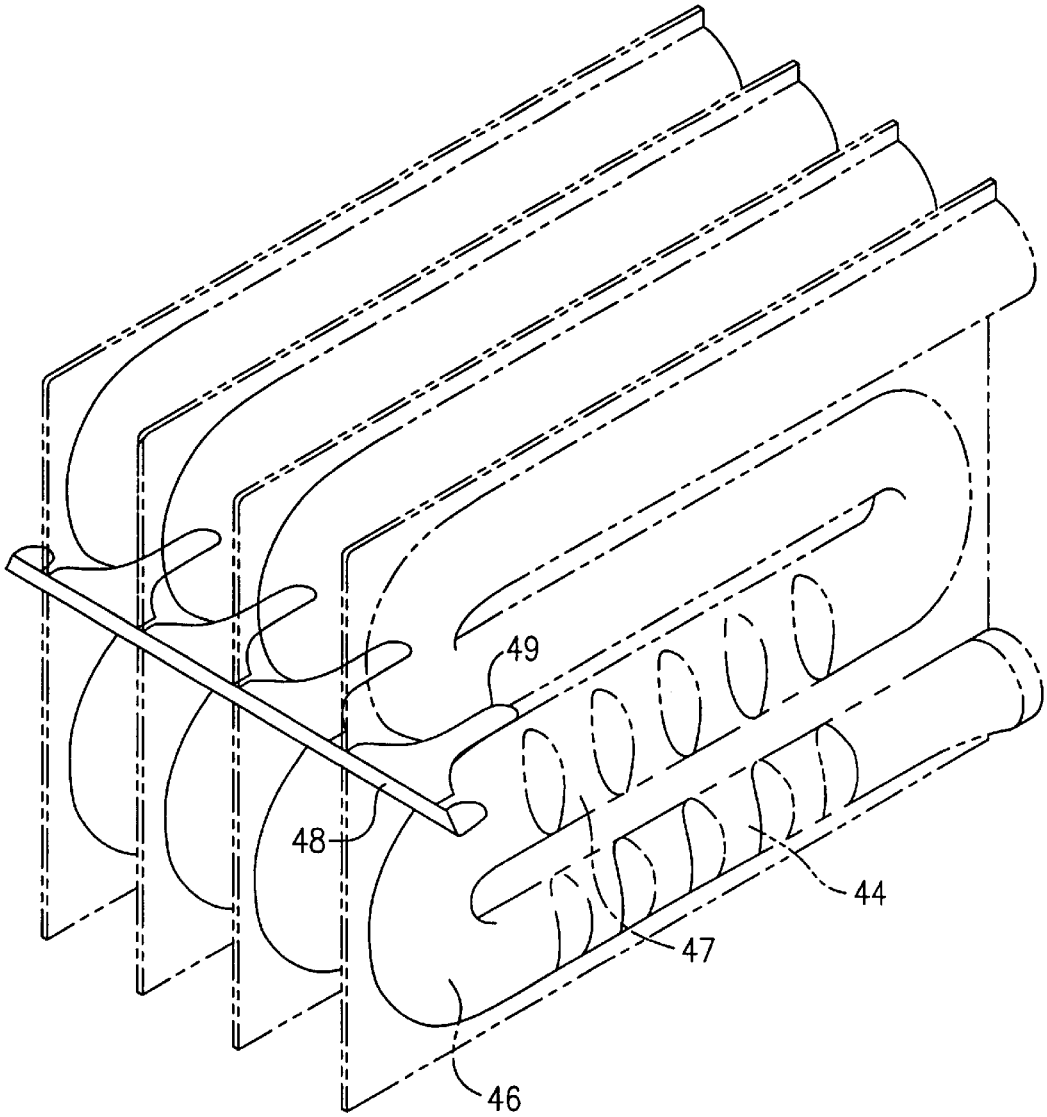
FIG. 3 is a perspective view of the present invention as applied to heat exchanger panels of a non-counterflow furnace.

While the present invention has been described in terms of use with a counterflow furnace (i.e. with the heated gases flowing downwardly and the circulation air flowing upwardly), it is equally applicable to a non-counterflow furnace wherein both the heated gases and the circulation air are flowing in the same direction as shown in FIG. 3. Here, the first pass 44 is at the bottom, and the hot gases pass upwardly through the first return bend 46, into the second pass 47, etc., while the circulation air flows in the same direction, i.e. upwardly . In this case, hot spots are still likely to occur in the same area, i.e. between the first return bend 46 and the second pass 47. It is therefore necessary to mount the bracket 48 at a vertical height that is just below the upper surface of the second pass 47, such that the baffles 49 are so positioned that the upward flowing circulation air is diverted over the location where the hot spots are likely to occur so as to thereby prevent their occurrence.

While the present invention has been described in various embodiments, it will be understood that those skilled in the art that the invention is not limited to these embodiments and that various modifications can be made thereto without departing from the true scope and spirit of the invention.

What is claimed is:

1. A baffle arrangement for a furnace of the type having a plurality of heat exchanger panels arranged in side-by-side relationship for the transfer of heat from hot gases flowing internally therein to air being circulated over the outer surfaces thereof, at least one of said heat exchanger panels being susceptible to hot spots at a particular location on its surface, comprising:

at least one baffle member mounted in said furnace and extending substantially in parallel relationship between a pair of said heat exchanger panels and being so positioned and spaced from said location that a substantial portion of the air being circulated is diverted to said location to prevent the occurrence of hot spots.

2. A baffle arrangement as set forth in claimed 1 wherein said heat exchanger panel is of the clam shell type.

3. A baffle arrangement as set forth in claimed 1 wherein said heat exchanger panel includes multiple passes and further wherein said hot spot location is in a second pass.

4. A baffle arrangement as set forth in claimed 1 wherein said baffle member is relatively planar and elongate in shape.

5. A baffle arrangement as set forth in claimed 1 wherein said baffle member extends from and is supported by a bracket that is installed between said plurality of heat exchanger panels for maintaining proper spacing therebetween.

6. A baffle arrangement as set forth in claimed 5 wherein said baffle member forms an integral part of said bracket.

7. A battle arrangement as set forth in claimed 5 wherein said bracket is secured to a casing of the furnace.

8. In a furnace having a plurality of heat exchanger panels arranged in parallel relationship, burners for introducing heated gases internally of the panels, and a blower for circulating air over the panels so as to be heated, a baffle arrangement comprising:

at least one baffle mounted in the furnace and extending between a pair of adjacent panels, said baffle being so positioned and spaced from to said panels as to divert a portion of the circulated air to a location on at least one panel in which hot spots would otherwise tend to occur.

9. A baffle arrangement as set forth in claim 8 wherein said heat exchanger panel is of the clam shell type.

10. A baffle arrangement as set forth in claim 8 wherein said heat exchanger panel includes multiple passes and further wherein said hot spot location is in a second pass.

11. A baffle arrangement as set forth in claim 8 wherein said baffle member is relatively planar and elongate in shape.

12. A baffle arrangement as set forth in claim 8 wherein said baffle member extends from and is supported by a bracket that is installed between said plurality of heat exchanger panel s for maintaining proper spacing therebetween.

13. Baffle arrangement as set forth in claim 12 wherein said baffle member forms an integral part of said bracket.

14. The baffle arrangement as set forth in claim 12 wherein said bracket is secured to a casing of the furnace.

* * * * *